US007155878B2

(12) United States Patent
Stemmle et al.

(10) Patent No.: US 7,155,878 B2
(45) Date of Patent: Jan. 2, 2007

(54) DEVICE FOR OPENING THE THROAT OF AN ENVELOPE IN AN INSERTION STATION

(75) Inventors: Denis J. Stemmle, Stratford, CT (US); Pascal Ferracani, Conches S/Gondoire (FR); Jean-Louis Potey, Courbevoie (FR); Patrick Archain, Courbevoie (FR); Dominique Bernard, Segre (FR)

(73) Assignee: Pitney Bowes Inc., Stamford, CT (US)

( * ) Notice: Subject to any disclaimer, the term of this patent is extended or adjusted under 35 U.S.C. 154(b) by 156 days.

(21) Appl. No.: 10/930,387

(22) Filed: Aug. 31, 2004

(65) Prior Publication Data

US 2006/0042196 A1 Mar. 2, 2006

(51) Int. Cl.
*B65B 43/26* (2006.01)
*B43M 3/04* (2006.01)

(52) U.S. Cl. ..... 53/381.5; 53/569; 53/284.3

(58) Field of Classification Search ..... 53/569, 53/284.3, 381.3, 381.5–381.7
See application file for complete search history.

(56) References Cited

U.S. PATENT DOCUMENTS 2,914,895 A * 12/1959 Martin ..... 53/381.7
3,568,401 A * 3/1971 Bonsch ..... 53/569
3,936,993 A * 2/1976 Dorer ..... 53/284.3
4,205,506 A * 6/1980 Moens et al. ..... 53/569
4,944,137 A * 7/1990 Krasuski et al. ..... 53/569
5,802,808 A * 9/1998 Lyga ..... 53/381.5
5,848,518 A * 12/1998 Bufalini et al. ..... 53/569
6,098,374 A * 8/2000 Yates et al. ..... 53/381.6
6,973,762 B1 * 12/2005 Miller et al. ..... 53/381.6

FOREIGN PATENT DOCUMENTS

EP 1270266 A2 * 1/2003

* cited by examiner

*Primary Examiner*—Stephen F. Gerrity
(74) *Attorney, Agent, or Firm*—Martin F. Noonan; George M. Macdonald; Angelo N. Chaclas

(57) ABSTRACT

An envelope insertion station having a plurality of actuating arms affixed to a rotatable shaft and a plurality of fingers pivotably mounted on the actuating arms for opening the throat of an envelope placed at an insertion area. The actuating arms are movable from a first position to a second position and then to a third position. When the actuating arms are in the first position, the fingers are freely pivotable so as to allow the envelope to be moved into the insertion area. When the actuating arms are in the second position, the fingers are caused to move along a defined path into the throat of the envelope placed at the insertion area. When the actuating arms are in the third position, the fingers are freely pivotable so as to allow enclosure material to move into the envelope through the throat.

16 Claims, 13 Drawing Sheets

DEVICE FOR OPENING THE THROAT OF AN ENVELOPE IN AN INSERTION STATION

TECHNICAL FIELD

The present invention relates generally to a document inserting machine and, more specifically, an envelope opening device in the inserting machine.

BACKGROUND OF THE INVENTION

A mail creation system, in general, has an enclosure supply section, an insertion station and a closing and sealing station. The enclosure supply section has a gathering section where the enclosure material is gathered before it is inserted into an envelope in the insertion station. This gathering section includes means to gather the various components of the mail piece into a coherent set, and may include a folder sub-system for folding the coherent set into a packet for insertion into an envelope. If the enclosure material contains many documents, these documents must be separately fed from different enclosure feeders, or may be sequentially fed from a single feeder, or created as individual printed sheets by a printer included in the gathering section. After all the released documents are gathered, they are put into a stack and may be folded into a packet to be inserted into an envelope in an inserting station. Envelopes are separately fed to the inserting station, one at a time, and each envelope is placed on a platform with its flap opened. At the same time, mechanical fingers or a vacuum suction device are used to keep the front face of the envelope on the platform while the throat portion of the back face of the envelope is moved upward to open the envelope. The stack of enclosure material is then automatically inserted into the opened envelope.

A typical mail creation system 1 is shown in FIG. 1, which has an enclosure supply station 20, an insertion station 100 and a flap closing and sealing station 30. As mentioned above, the enclosure supply station 20 can be an enclosure gathering station and may include a folding station. After the enclosure is inserted into an envelope in the insertion station 100, the flap on the stuffed envelope may be moistened, then closed and sealed. This can be carried out at the station 30. The station 30 may have a postage meter to provide a postage indicia on the envelope or a printer to address the envelope. Alternatively, the address may be put on the envelope before the envelope is advanced to the inserting station. Or, if the envelope is a windowed envelope, no addressing may be included in the process. The processed mailpieces are typically stacked.

Traditionally, it has been known that the step of opening the throat of an envelope is usually the most trouble prone portion of an insertion system. Paper jams, incomplete insertions, and damage to the envelopes are some of the common faults experienced on the current state-of-the art equipment. In some equipment, vacuum systems are sometimes employed to increase the reliability of the envelope throat opening operation. But this method is relatively expensive, and often requires operator adjustments for optimal performance.

In essence, the problem with traditional insertion fingers is that they can exert unwanted drag forces on the envelope while the envelope is being moved into the insertion area, and further exert unwanted drag forces on the packet while the packet is being moved into the envelope. These drag forces are often the cause of jams or incomplete insertions in the system. It is thus advantageous and desirable to provide a method and system for envelope insertion using insertion fingers wherein the drag forces can be substantially reduced.

Another problem which limits the performance of insertion fingers is the fact that envelopes can be very sensitive to the relative humidity in the air. Under certain humidity conditions, the envelopes can warp or curl, which makes it particularly difficult to insure that all of the insertion fingers enter the throat of the envelope without jamming or damaging the throat of the envelope. It is, thus, advantageous and desirable to provide a set of fingers which can tolerate a high degree of warp or curl on envelopes with a wide range of envelope sizes, shapes, with a wide range of throat shapes without operator adjustments.

SUMMARY OF THE INVENTION

The envelope insertion station, according to the present invention, has a plurality of actuating arms affixed to a rotatable shaft and a plurality of fingers pivotably mounted on the actuating arms for opening the throat of an envelope placed at an insertion area. The actuating arms are movable from a first position to a second position and then to a third position. When the actuating arms are in the first position, the fingers are freely pivotable so as to allow the envelope to be moved into the insertion area with very little drag from the fingers. When the actuating arms are in the second position, the fingers are caused to move through a constrained and defined path into the throat of the envelope placed at the insertion area. When the actuating arms are in the third position, the fingers are freely pivotable so as to allow enclosure material to move into the envelope through the throat.

Thus, the first aspect of the present invention provides a method for opening a throat of an envelope placed at a support surface in an insertion area to allow enclosure material to be inserted into the envelope. The method comprises the steps of:

providing at least one actuating arm movably disposed in relationship to the insertion area in a first position, a second position and a third position;

providing at least one finger having a first end and a second end, the first end of said at least one finger pivotably mounted on said at least one actuating arm, such that, when said at least one actuating arm is in the first position, the second end of the finger is free to pivot off the surface of the envelope so as to allow movement of the envelope into the insertion area;

moving said at least one actuating arm to the second position after the placement of the envelope at the insertion area, for causing the second end of the finger to move into the throat of the envelope for opening the envelope; and moving said at least one actuating arm to the third position after the second end of the finger is caused to move into the throat of the envelope, such that when said at least one actuating arm is in the third position, the second end of the finger is free to pivot so as to allow movement of the enclosure material into the envelope through the throat.

According to the present invention, the upper surface of the finger is a cam-like surface such that when the actuating arm is in the second position, the upper surface of the finger is in the proximity of a restricting surface to limit the pivoting motion of the finger. As such, the gap between the lower surface of the finger and the support surface is limited to the thickness of the envelope, or the gap is just enough to accommodate the lower ply of the envelope.

According to the present invention, the insertion station has one or more rollers movably mounted on a shaft for moving the envelope into the insertion area, and the restricting surface is part of the circumference of the shaft or part of a collar on the shaft.

According to the present invention, the support surface may have a depression to allow part of the lower ply of the envelope to move below the support surface when said at least one actuating arm is in the second position.

The second aspect of the present invention provides an envelope insertion station, which comprises:

an insertion area having a support surface;

a driving mechanism having one or more rollers for driving an envelope into the insertion area, the envelope having a throat; and an envelope opening device, the envelope opening device comprising:

at least one actuating arm movably disposed in relationship to the insertion area in a first position, a second position and a third position;

at least one finger having a first end and a second end, the first end of said at least one finger pivotably mounted on said at least one actuating arm for pivoting motion, such that when said at least one actuating arm is in the first position, the second end of the finger is spaced from the throat of the envelope, and when said at least one actuating arm is in the second position, the second end of the finger is moved into the throat of the envelope; and an actuating device, operatively connected to said at least one actuating arm, for moving said at least one actuating arm from the first position to the second position and then to the third position. When the actuating arm is in the first position, the finger is freely pivotable to minimize the friction between the finger and the moving envelope, and when the actuating arm is in the third position, the finger is freely pivotable to minimize the friction between the finger and the moving enclosure material. When the finger is at the second position, the gap between the tip of the finger and the support surface is approximately equal to the thickness of one ply of the envelope.

The third aspect of the present invention provides a mailing system, which comprises:

an enclosure supply station; and an envelope insertion station, disposed in relationship to the enclosure supply station for receiving enclosure material from the enclosure supply station, wherein the envelope insertion station comprises:

an insertion area;

a driving mechanism for driving an envelope into the insertion area, the envelope having a throat; and an envelope opening device, the envelope opening device comprising:

at least one actuating arm movably disposed in relationship to the insertion area between a first position and a second position;

at least one finger having a first end and a second end, the first end of said at least one finger pivotably mounted on said at least one actuating arm for pivoting motion, such that when said at least one actuating arm is in the first position, the second end of the finger is spaced from the throat of the envelope and substantially free to pivot, and when said at least one actuating arm is in the second position, the second end of the finger is moved into the throat of the envelope along a defined path so as to allow the enclosure material to be moved into the envelope through the throat; and an actuating device, operatively connected to said at least one actuating arm, for moving said at least one actuating arm between the first position and the second position.

According to the present invention, the actuating arm is also movably disposed in a third position after the second end of the finger is caused to move into the throat of the envelope, such that when said at least one actuating arm is in the third position, the second end of the finger is free to pivot so as to minimize friction between the enclosure material and the finger when the enclosure material is moved into the envelope through the throat.

The present invention will become apparent upon reading the description taken in conjunction with FIGS. 2 to 4*d*.

DETAILED DESCRIPTION OF THE INVENTION

Figure 1:
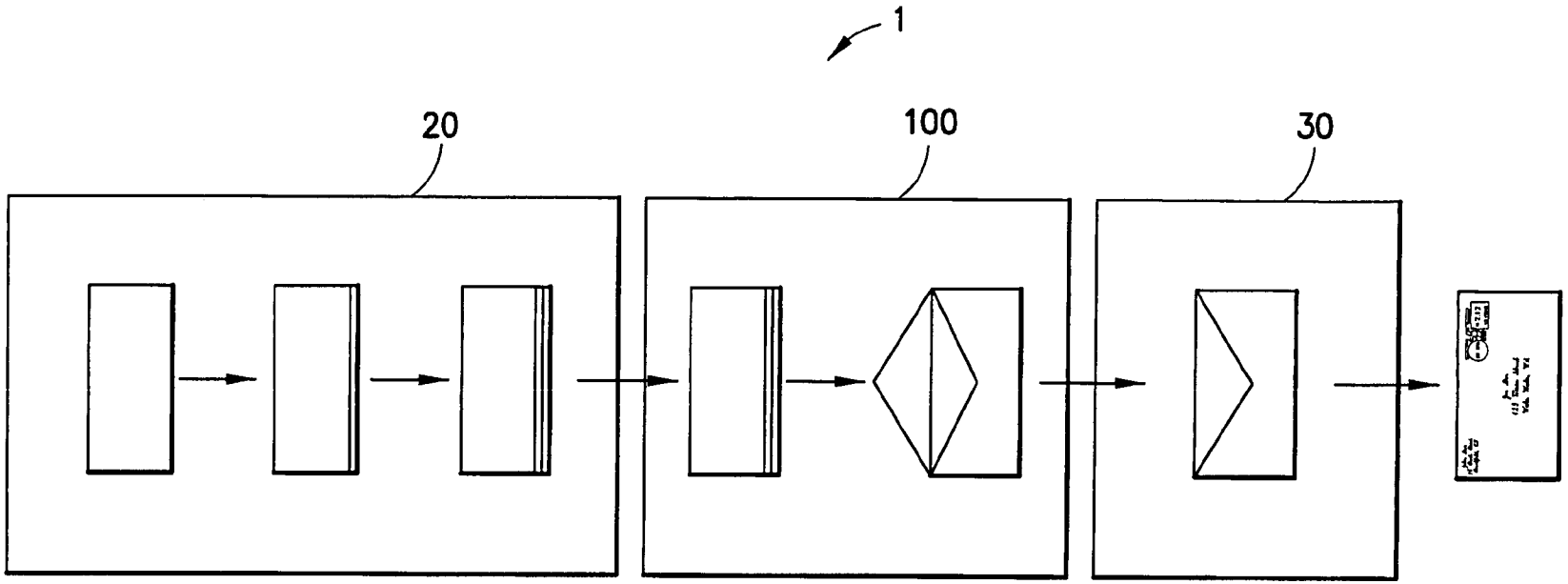
FIG. 1 is a schematic representation showing a typical mailing machine having an insertion station.
Figure 2:
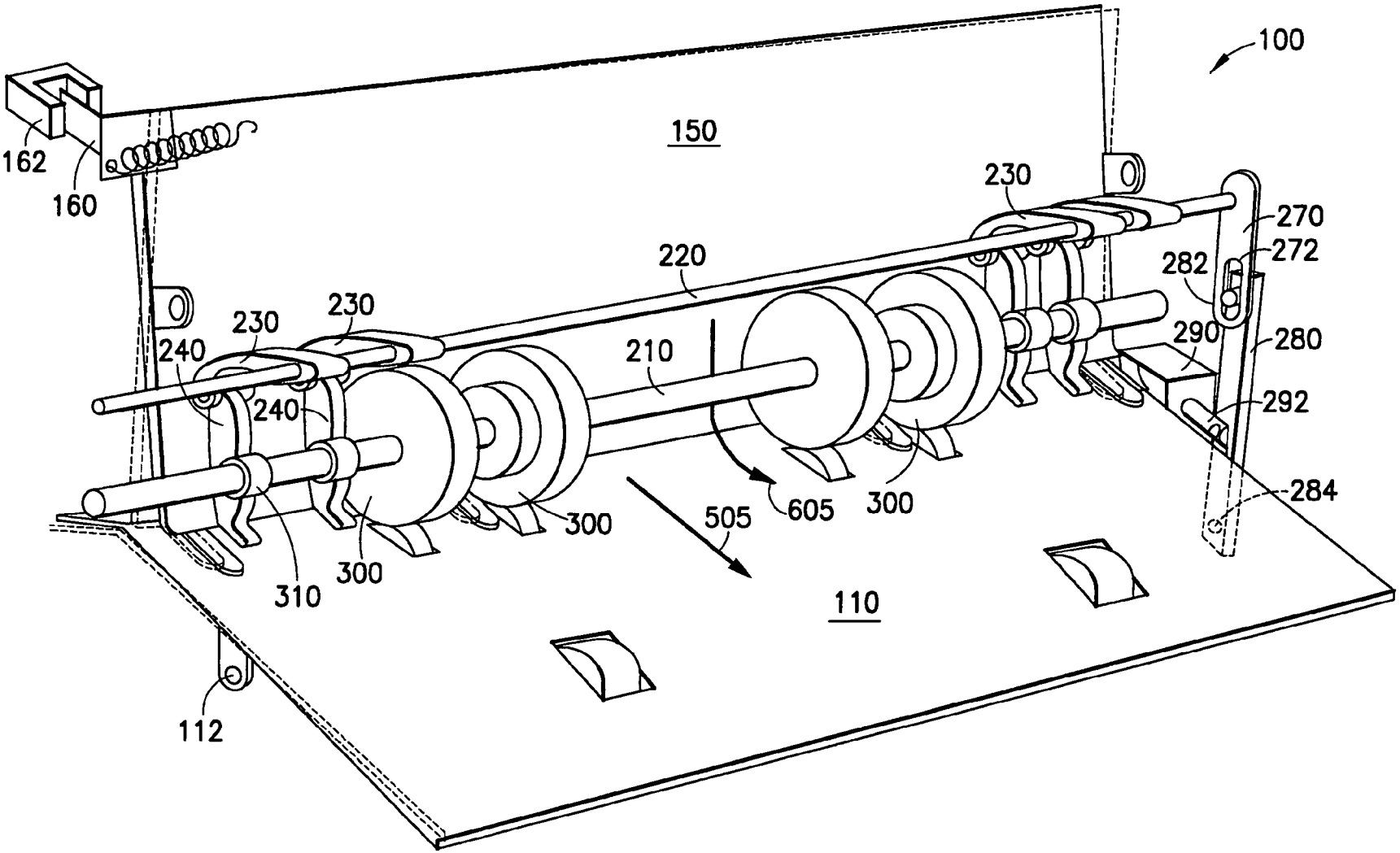
FIG. 2 is a perspective view of the insertion station, according to the present invention.

The insertion station 100, according to the present invention, is shown in FIG. 2. As shown, the insertion station 100 has a support platform 110 for supporting an envelope for enclosure insertion after the envelope is moved into the insertion station along a moving path 505. The insertion station 100 has a chute 150 for guiding a packet of enclosure material 600 (see FIGS. 3*e* and 3*f*) along a moving path 605 into an envelope 500 (see FIGS. 3*a*–3*f*) located on the support platform 110. The envelope 500 and the packet 600 are separately driven into their intended positions by a plurality of drive rollers 300, which are mounted on a mounting shaft 210. As can be seen in FIGS. 3*d* to 3*g*, the throat of the envelope 500 positioned in the insertion station 100 is opened by a plurality of fingers 240 so that the packet 600 can be properly inserted into the envelope 500. As shown in FIG. 2, each of the fingers 240 is pivotably mounted on an arm 230. The arms 230 are mounted on a common shaft 220, which is connected to a linkage 270. The linkage 270 has a slot 272 movably engaged with a slot pin 282. The slot pin 282 is fixedly disposed on a lever arm 280, which is pivotably mounted at pivot 284. The level arm 280 is operatively connected to an actuator 290 through an actuator linkage 292. Through the action of the actuator 290, the shaft 220 moves the fingers 240 to different positions. The insertion station 100 may have a plurality of collars 310 mounted on the mounting shaft 210 for operatively engaging with the fingers 240.

The support platform 110 is pivotably mounted at pivot 112 so that the support platform 110 can be moved between two positions, as depicted by dashed lines and the corresponding solid lines in FIG. 2. Likewise, the chute 150 can be moved between two positions as depicted by the dashed lines and the corresponding solid lines. The chute 150 is also connected to a flag 160 disposed in relationship to a sensor 162, allowing the sensor 162 to sense the positions of the chute 150.

Figure 3A:
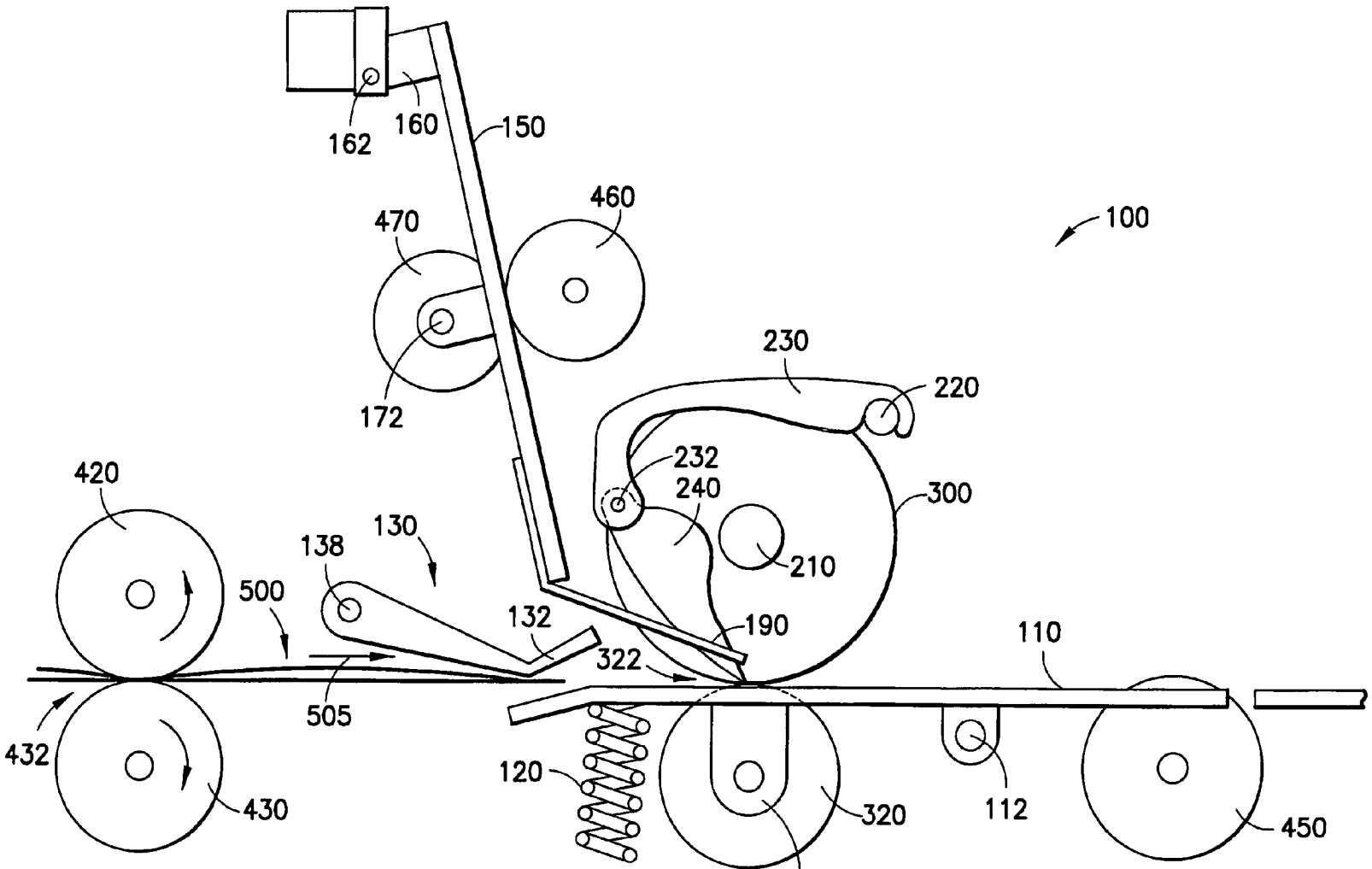
FIG. 3*a* is a schematic representation showing the insertion station, according to the present invention, when the lead edge of an envelope is being moved into the insertion station.
Figure 3B:
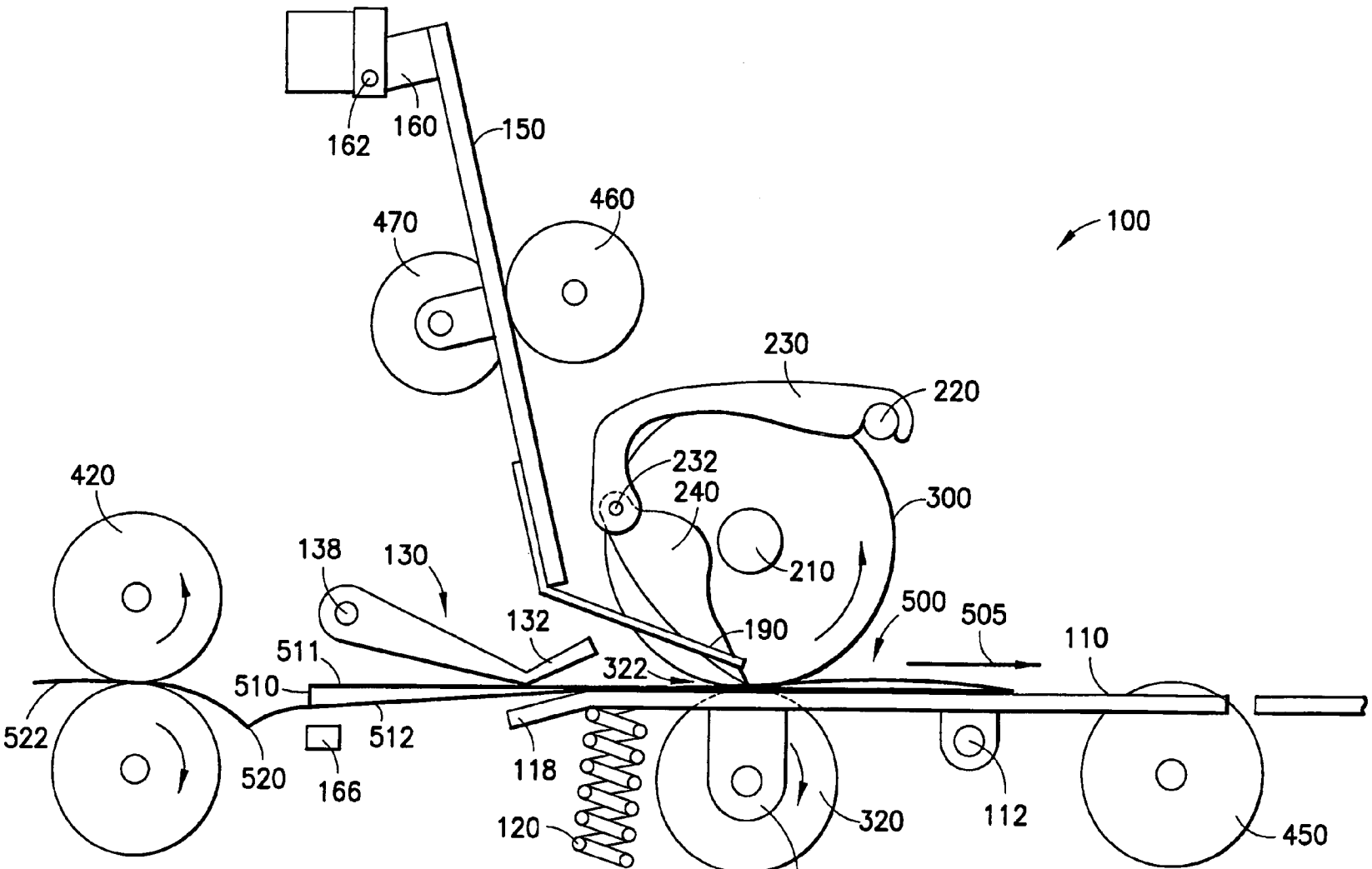
FIG. 3*b* is a schematic representation showing the insertion station, before the envelope is placed at the insertion location.
Figure 3C:
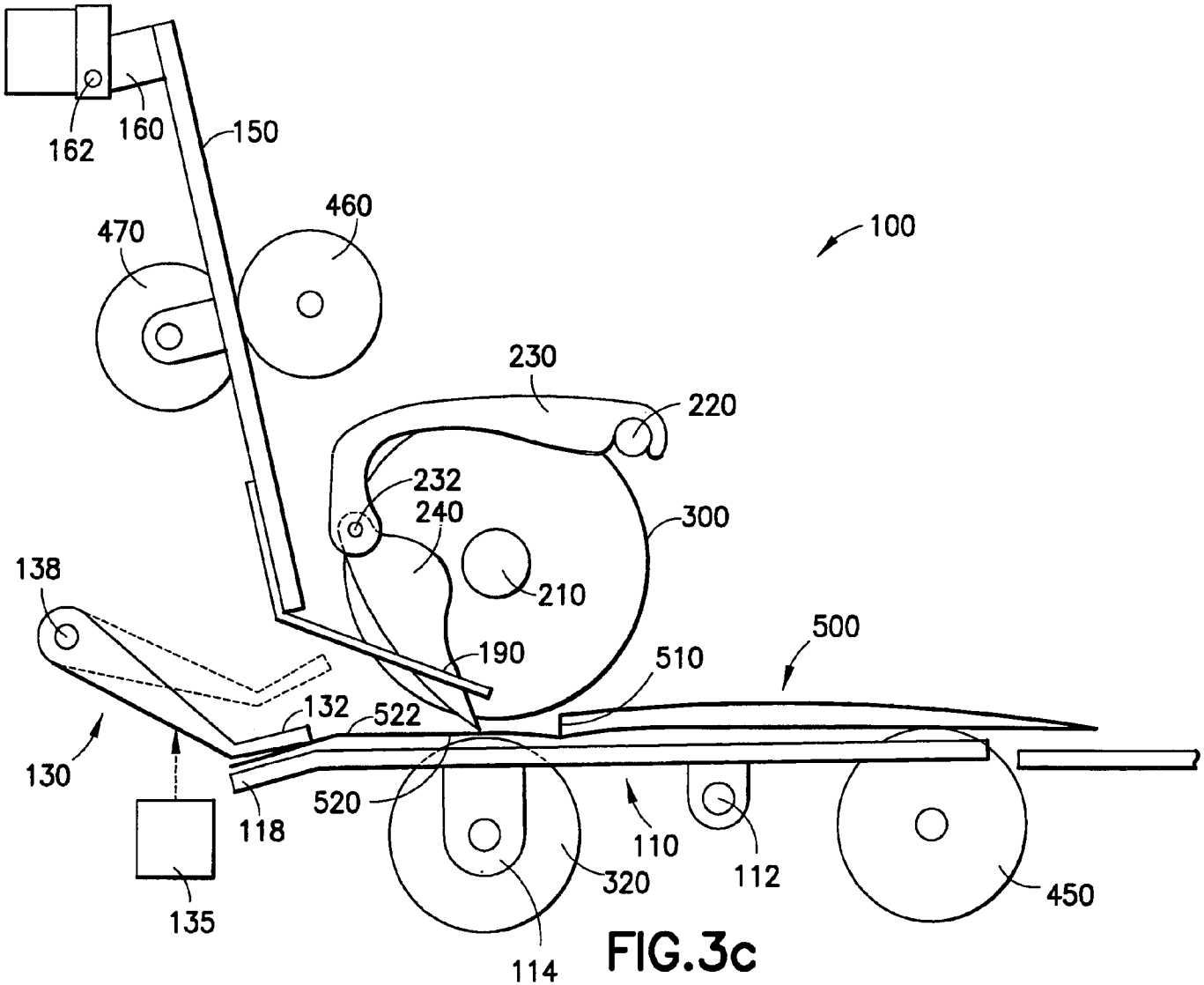
FIG. 3*c* is a schematic representation showing the insertion station, wherein the envelope is kept in place before the throat of the envelope is opened.
Figure 3D:
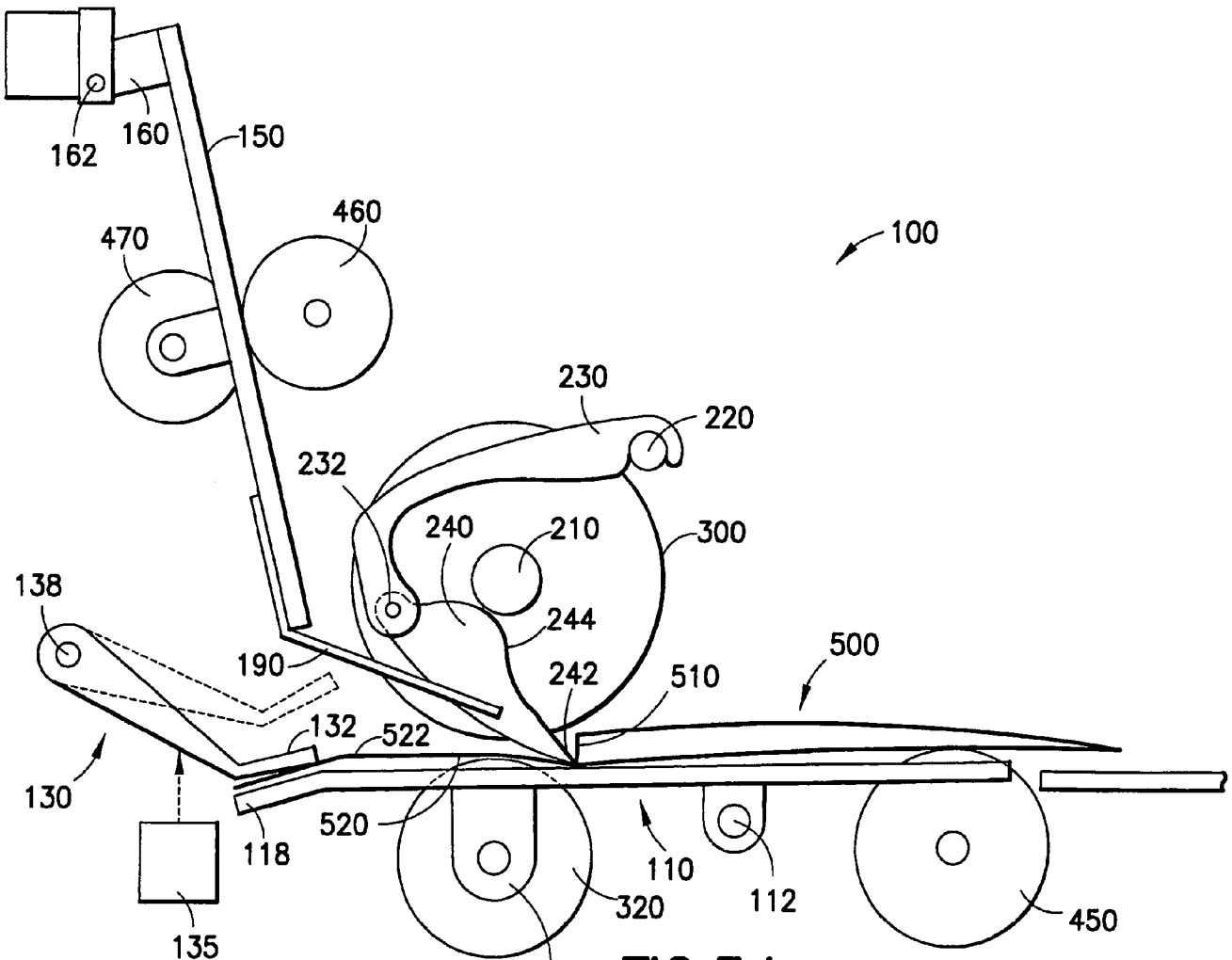
FIG. 3*d* is a schematic representation showing the insertion station, wherein the finger is moved toward the throat of the envelope in order to open the throat.
Figure 3E:
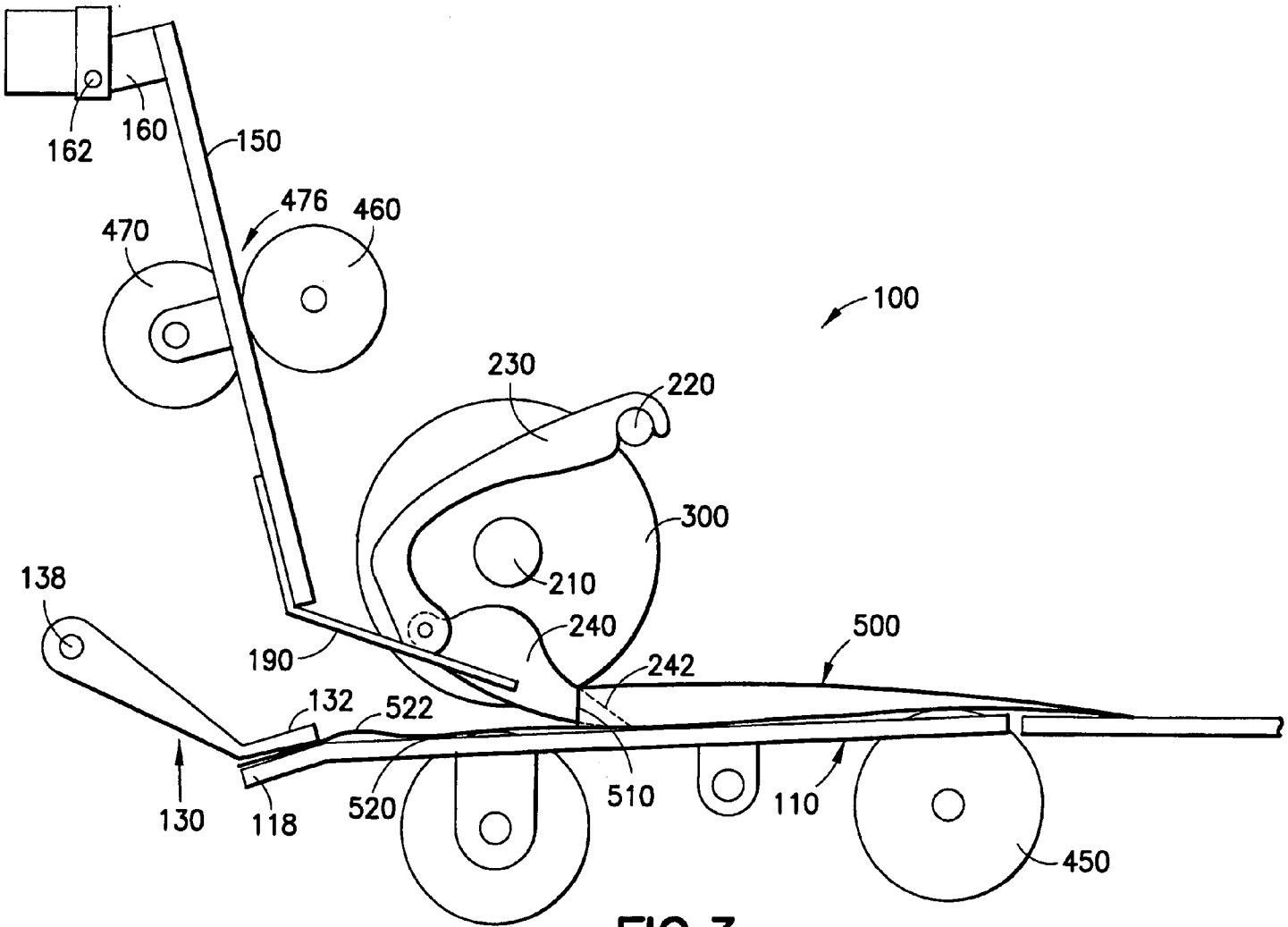
FIG. 3*e* is a schematic representation showing the insertion station when the throat of the envelope is opened.
Figure 3F:
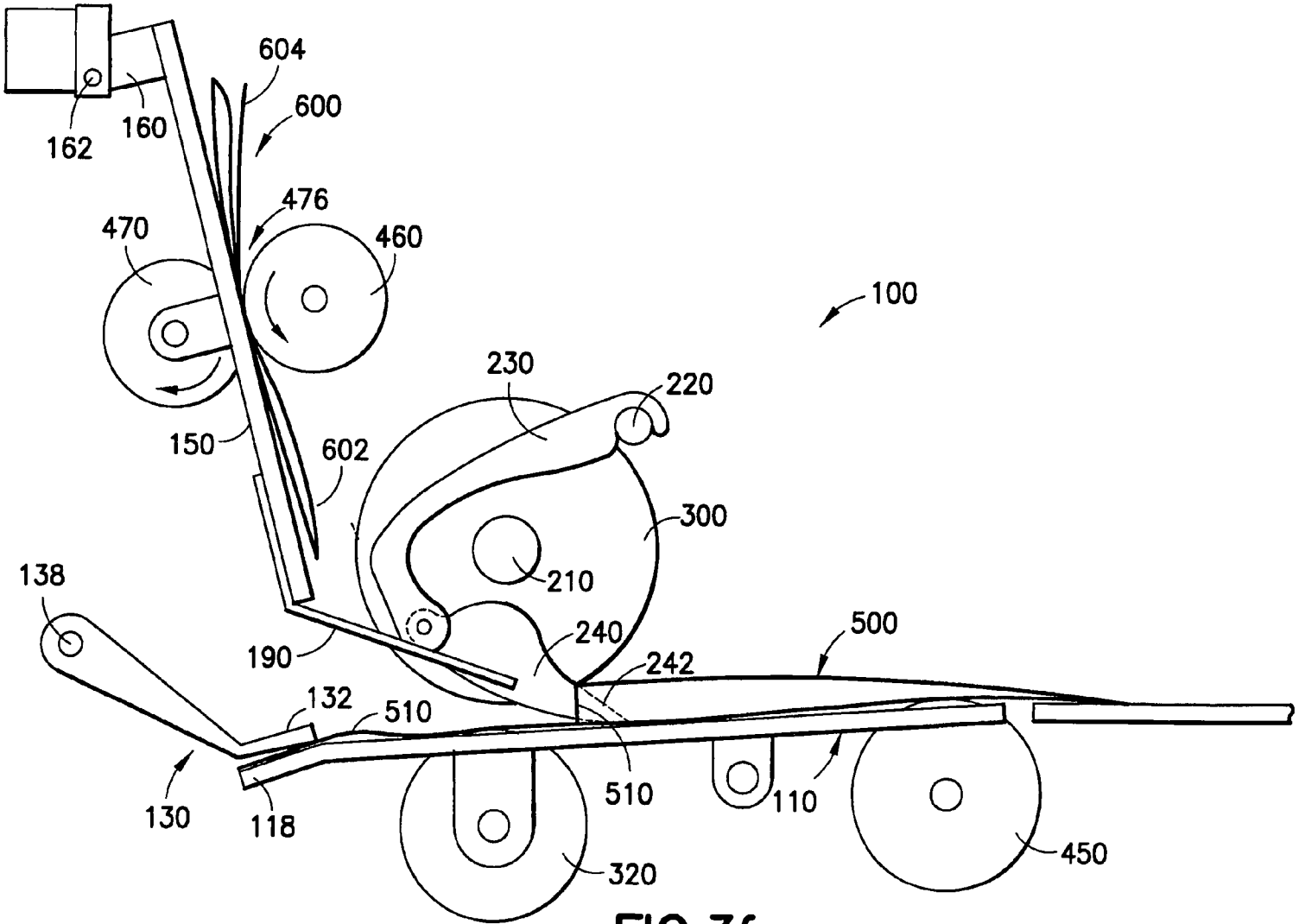
FIG. 3*f* is a schematic representation showing the enclosure packet being moved toward the insertion station.
Figure 3G:
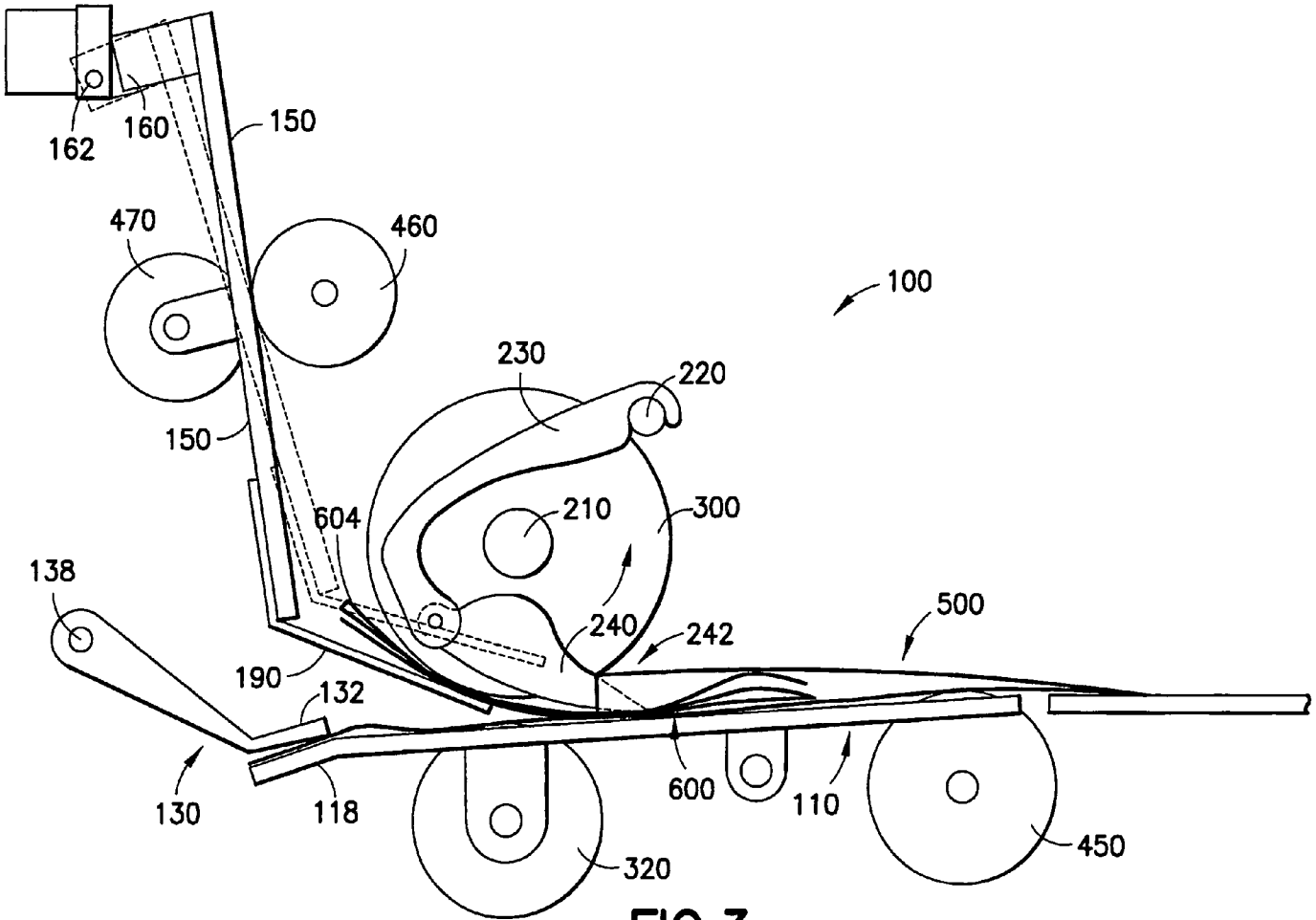
FIG. 3*g* is a schematic representation showing the enclosure packet being inserted into the envelope.

The envelope insertion process is illustrated in FIGS. 3*a* through 3*g*. For simplicity, only one each of the arms 230, fingers 240, rollers 300 and rollers 320 is shown in FIGS. 3*a*–3*b* in order to describe the insertion process. FIGS. 3*a* and 3*b* show the envelope 500 being driven by a nip 432 formed by rollers 420 and 430 along a moving direction 505. FIGS. 3*c* to 3*g* show the envelope 500 after it has reached a pre-determined location. FIGS. 3*f* and 3*g* show the packet 600 being driven into the envelope 500. As shown in these figures, the finger 240 is pivotably mounted on the arm 230 at arm pivot 232. The finger 240 is freely rotatable so as to reduce the drag to the envelope 500 when the envelope 500 is moved into position.

As previously mentioned, the support platform 110 can be moved between two positions. As shown in FIGS. 3*a* and 3*b*, the support platform 110 is urged by a spring 120 to stay at a first position. At this position, the support platform 110 allows the roller 320 to form a nip 322 with the roller 300 for moving the envelope 500 along the moving direction 505, as shown in FIG. 3*b*. The roller 320 is rotatably mounted on a roller mount 114 affixed to the bottom side of platform 110. The envelope 500 has an upper ply 511 and a lower ply 512.

The insertion station 100 has at least one depressor arm 130, disposed in relationship with one end of the support platform 110. As shown in FIGS. 3*a*–3*f*, the depressor arm 130 is pivotably mounted at pivot 138 so that the arm 130 can be moved between an upper position and a lower position. When the arm 130 is located at the upper position, it allows the envelope 500 to be driven to the pre-determined location, as shown in FIGS. 3*a* and 3*b*. When the envelope 500 arrives at the pre-determined location, the arm 130 is moved to the lower position, as shown in FIGS. 3*c* to 3*f*.

The envelope 500, as shown in FIG. 3*b*, has a throat 510, and a flap 522 foldable along the fold line 520. The nip 322 formed by the rollers 300 and 320 keeps driving the envelope 500 until the flap fold line 520 reaches a correct position. This "correct position" can be determined by a paper path sensor 166 and a time delay, for example. The sensor 166 can be located upstream as shown, or it can be located even further upstream of rollers 420 and sense the fold line of the flap before the flap is opened. The time delay can be generated by a system controller (not shown) based on the moving speed of the envelope and the location of the sensor relative to the designated location of the envelope 500.

After the envelope flap fold line 520 arrives at the correct position, the depressor arm 130 is actuated by an actuator 135, such as a solenoid, so that the arm 130 rotates downward to its lower position. As such, it presses one end 118 of the support platform 110 downward, disengaging the roller 320 from the roller 300, thereby eliminating drive nip 322. At the same time, the flap 522 is held between the tip 132 of the arm 130 and the end section 118 of the support platform 110, as shown in FIG. 3*c*. At this stage, the roller 300 is no longer used for driving the envelope 500. The driver roller 300 continues to rotate, but the drive force on the envelope 500 has been removed.

After the envelope 500 is held in placed by the depressor arm 130, the shaft 220 is moved by the actuator shaft 292 so as to cause the arm 230 to rotate, pushing the tip 242 of the finger 240 toward the throat 510 of the envelope 500, as shown in FIG. 3*d*. At this stage, the path of the finger is controlled by the gap between the upper surface 244 of the finger 240 and the shaft 210. As shown in FIG. 3*d*, because the close proximity of the upper surface 244 to the shaft 210, the finger 240 is not freely rotatable when it is moved toward the throat. The shaft 210 causes the tip 242 of the finger to press down the front portion of the envelope 500 when the finger is moved toward the throat. But when the finger 240 has been substantially moved into the throat, the upper surface 244 of the finger 240 is spaced from the shaft 210 again, allowing the finger 240 some pivoting movement, as shown in FIG. 3*e*. A short time later, the nip 476 formed by the rollers 460 and 470 drives the packet 600 toward the envelope 500, as shown in FIG. 3*f*. When the lead edge 602 (see FIG. 3*f*) of the packet 600 moves past the leaf springs 190, it deflects the leaf springs downward, causing the chute 150 to move to a second position, as shown in FIG. 3*g*. As the chute 150 is moved to its second position, the flag 160 is operatively disengaged from the flag sensor 162. The flag sensor 162 changes its state. At this stage, the leaf springs 190, in cooperation with the rollers 300, provides a normal force to drive the packet 600 into the envelope 500.

After the trail edge 604 of the packet 600 has passed the tip of the leaf springs 190, the chute 150 returns to its home or first position. As the flag sensor 162 sees the flag 160 again, the flag sensor 162 reverts to its original state. This state reversion indicates that the packet 600 is successfully inserted into the envelope 500. Thus, the flag sensor 162 can be used for jam monitoring and system timing, for example.

Figure 4A:
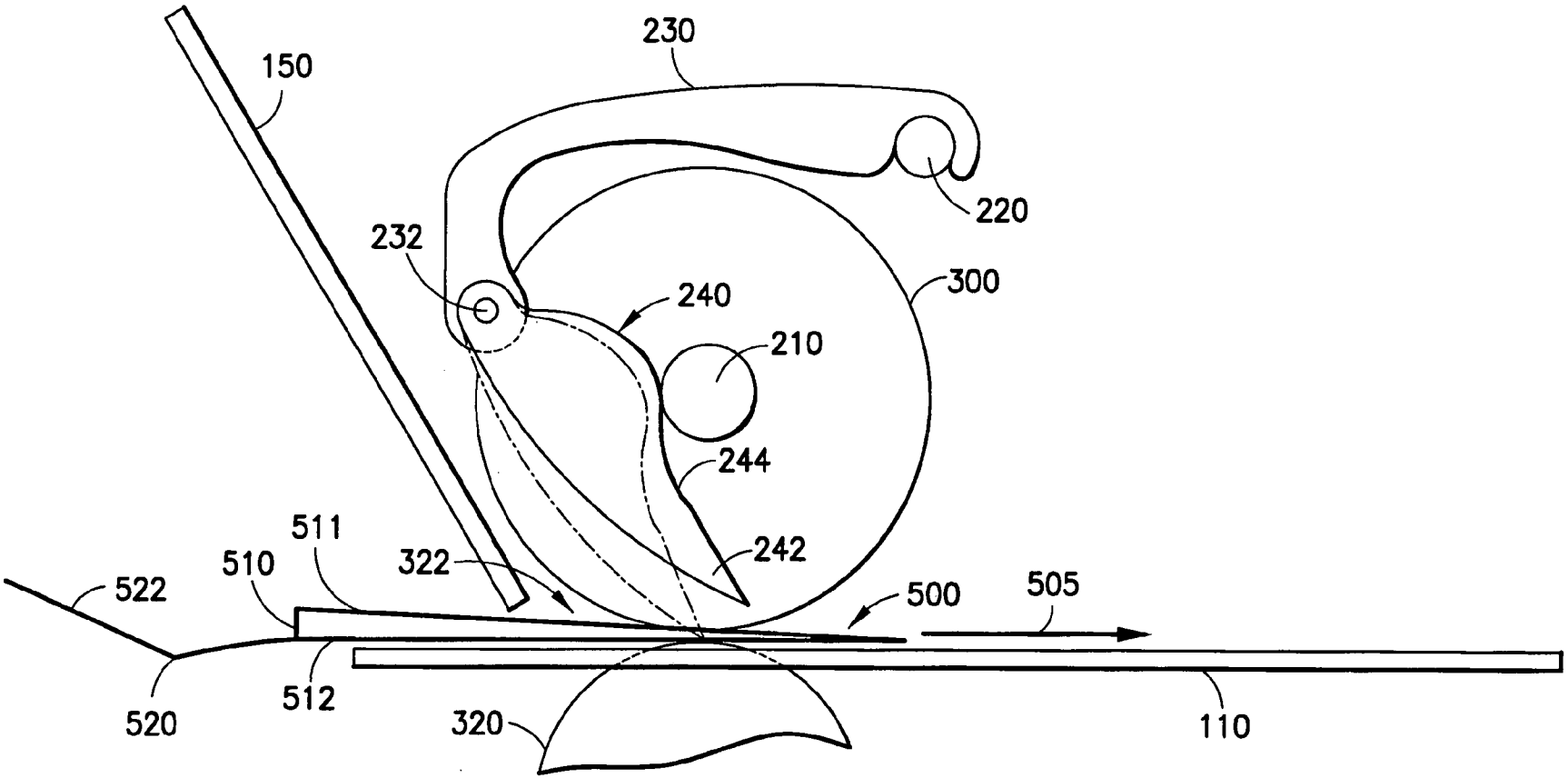
FIG. 4*a* is a schematic representation showing the relationship between the finger and mounting shaft before the envelope is placed at the insertion position.

It should be noted that the upper surface 244 of the finger 240 is spaced from the shaft 210, leaving a gap therebetween, when the arm 230 is located at its home position, as shown in FIG. 4*a*. Thus, when the finger 240 is not used to open the throat 510 of the envelope 500, the finger 240 is easily pushed upward by the envelope 500 when the envelope 500 is moved through the nip 322 formed by the rollers 300 and 320. This allows the envelope to pass below fingers 240 with minimum drag forces exerted on the envelope by the fingers.

It is possible to choose a cam-like contour for the upper surface 244 such that the displacement of the finger 240 is affected by its contact with the shaft 210 during a portion of the finger travel. It is possible to describe the travel of finger 240 during actuation in three stages. The first stage occurs during the initial movement of arm 230 and finger 240, before the upper surface 244 contacts the surface of shaft 210. During this first stage, the finger is free to pivot about pivot 232, similar to the motion shown in FIG. 4*a*. Before the finger begins to move and while the finger is moving during this first phase, finger 240 is free to rotate, and the tip of the finger 242 is free to ride across the surface profile of the envelope without exerting substantial force on the envelope.

Figure 4B:
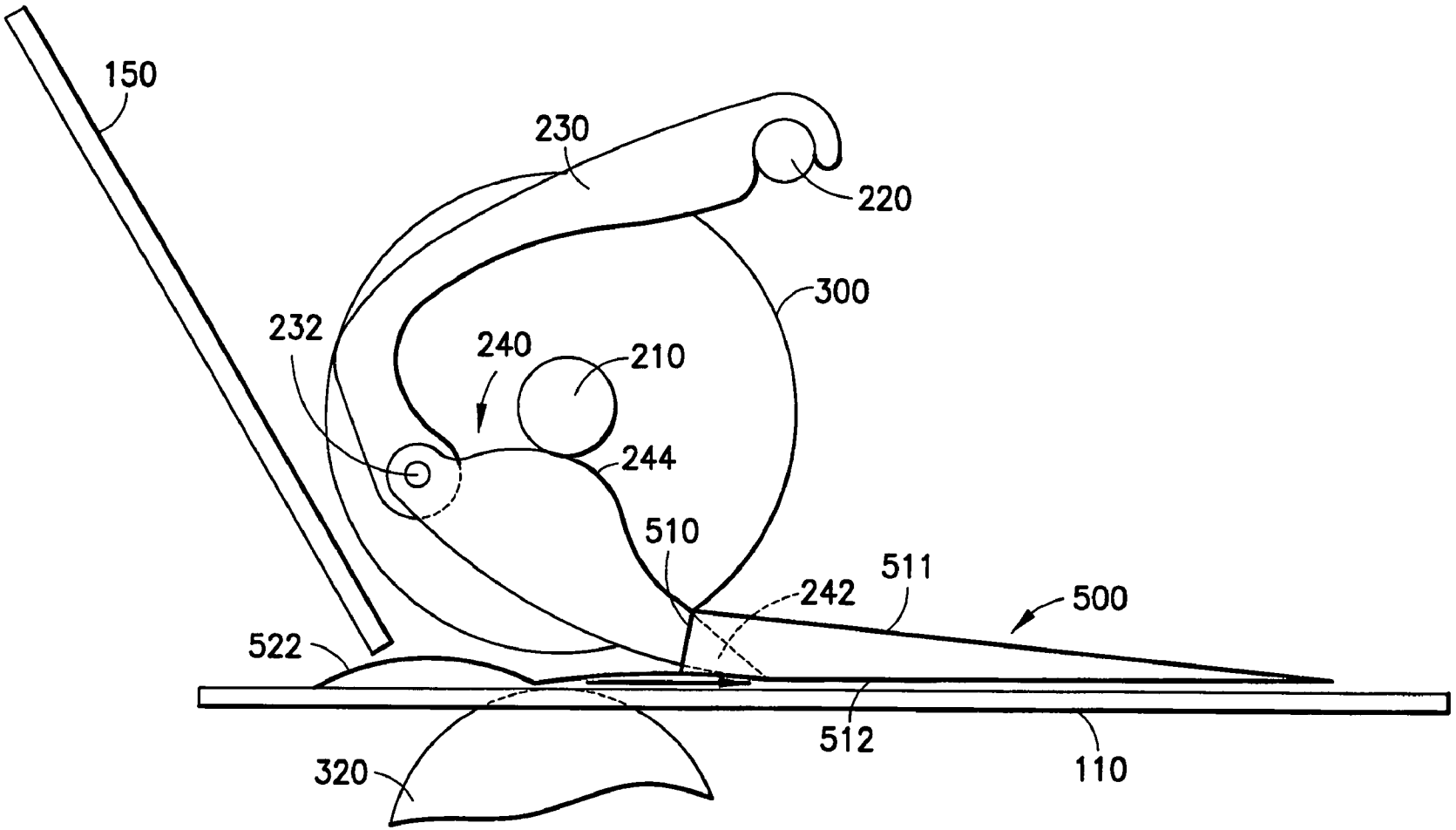
FIG. 4*b* is a schematic representation showing the relationship between the finger and the mounting shaft when the finger is moved into the throat of the envelope.

The second stage occurs when the tip 242 of finger 240 moves into the throat 510 of envelope 500. During this stage, the path of tip 242 is precisely controlled by the interaction of upper surface 244 with the circumference of shaft 210. The precisely controlled path of tip 244 is defined as a line parallel to the top surface of support plate 110, said path line located above the surface of 110 by a dimension approximately equal to the thickness of one ply of the paper in the envelope. As shown in FIG. 4*b*, the throat of the envelope is comprised of the upper ply 511 and the lower ply 512. Because the envelope 500 can be curled, warped, or otherwise distorted from the ideal flat condition, the exact locations of each of the plies 511 and 512 cannot be known. In order to insure successful opening the throat 510, the precisely controlled path of tip 242 of the finger 240 during the second stage will cause the tip 242 to press the lower ply 512 of the envelope 500 against the top surface of support platform 110 in order to flatten out any curl, warpage, or distortion in the area of the envelope throat 510, insuring that the finger 240 moves beneath the upper ply 511 into the throat 510.

Figure 4C:
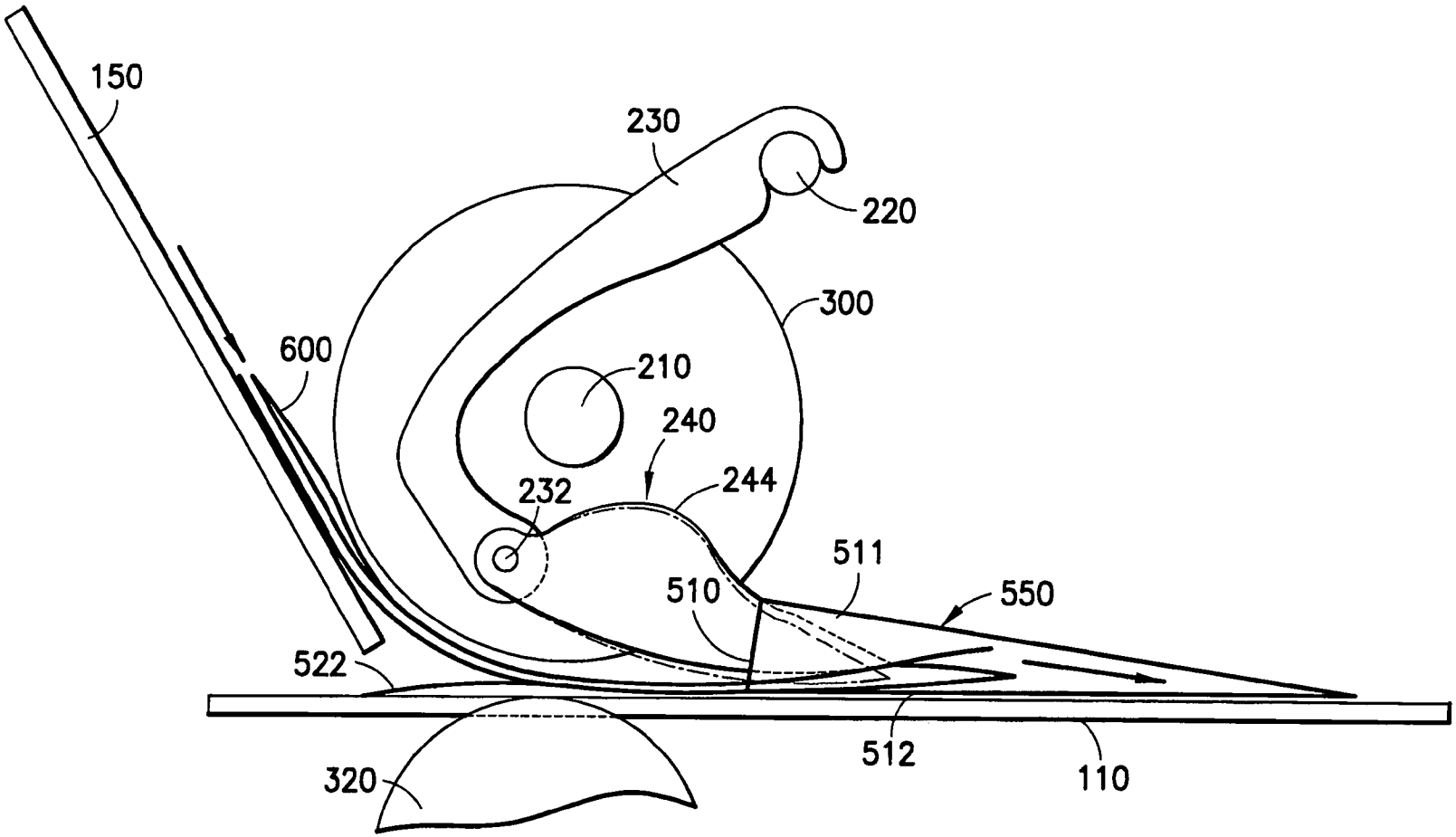
FIG. 4*c* is a schematic representation showing the relationship between the finger and the mounting shaft when the throat is fully opened.

The third stage occurs after the finger tip 242 has adequately opened the throat 510. The upper surface 244 is again spaced from the circumference of the shaft 210, as shown in FIG. 4*c*. As such, the tip 242 of the finger 240 can be pushed upward by the packet 600, thereby reducing the drag on the packet when the packet is moved into the envelope.

It should be noted that the movement of the finger 240 and the arm 230 in the three stages, as described in conjunction with FIGS. 4*a* to 4*c*, can be substantially a continuous movement. However, the movement can also be an intermittent movement in that a brief pause can occur between stages.

Figure 4D:
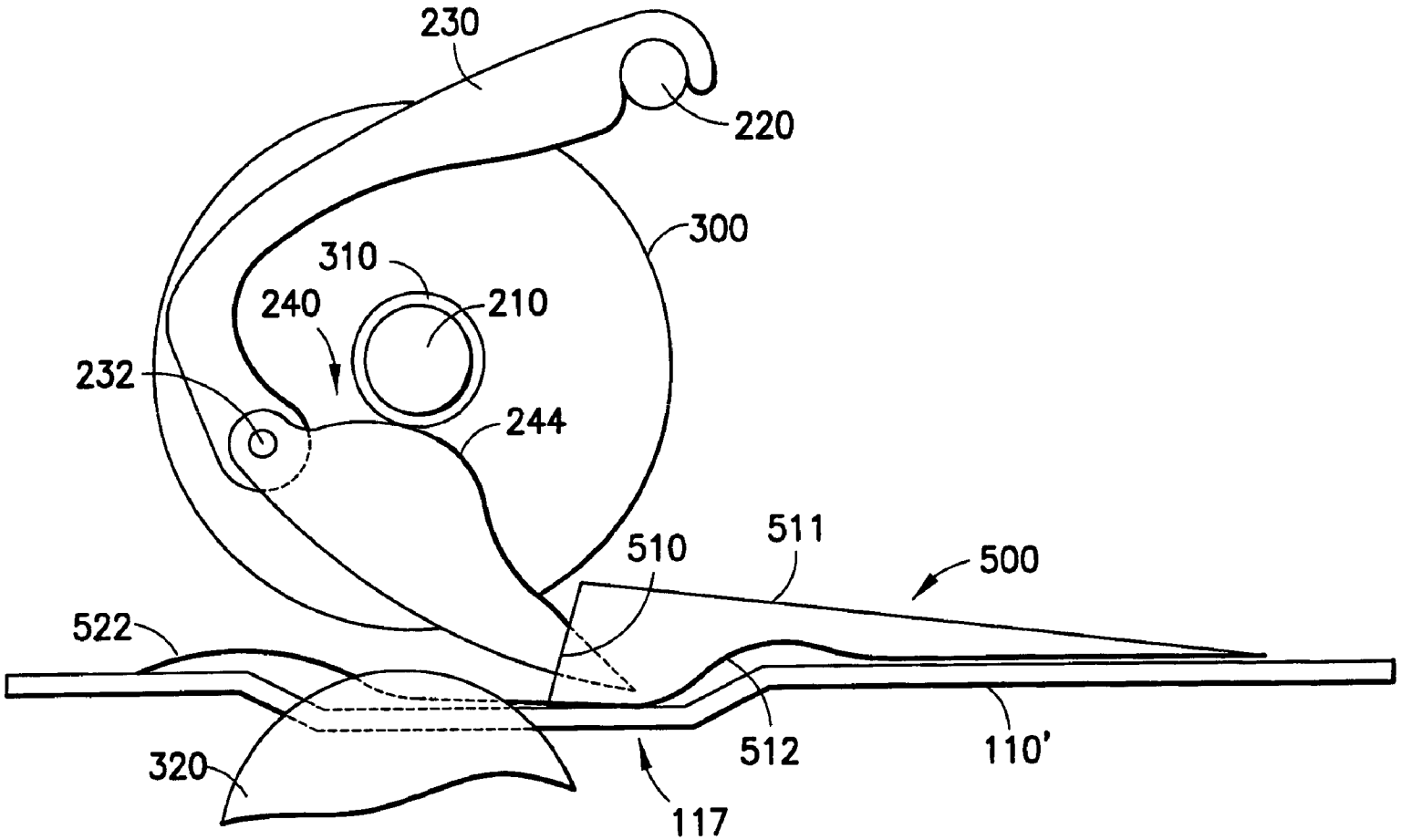
FIG. 4*d* is a schematic representation showing a collar disposed on the mounting shaft and a depression on the support platform.

Furthermore, it is possible to install a plurality of collars 310 (see FIG. 2) on the mounting shaft 210 and to allow the collars to rotate freely on the shaft 210. With a modified contour, the upper surface 244 of the finger 240 can make contact with the collar instead of the shaft 210. The collars 310 can reduce the wear on the fingers 240 and shaft 210. Moreover, it is possible to provide one or more depressions on the support platform 110 to help pre-open the envelope 500, as shown in FIG. 4*d*. If depressions are used, the movement of the tip 242 of finger 240 may be beneficially selected during the second stage to a path that is equal to or slightly below the top surface of support platform 110 to enhance the probability of the finger tips 242 entering throat 510.

Although the invention has been described with respect to one or more embodiments thereof, it will be understood by those skilled in the art that the foregoing and various other changes, omissions and deviations in the form and detail thereof may be made without departing from the scope of this invention.

What is claimed is:

1. An envelope insertion station comprising:

an insertion area;

a driving mechanism for driving an envelope into the insertion area, the envelope having a throat; and an envelope opening device, the envelope opening device comprising:

at least one actuating arm movably disposed in relationship to the insertion area between a first position, a second position, and a third position;

at least one finger having a first end and a second end, the first end of said at least one finger pivotably mounted on said at least one actuating arm for pivoting motion, such that when said at least one actuating arm is in the first position, the second end of the finger is free to pivot so as to allow movement of the envelope into the insertion area and to be spaced from the throat of the envelop, and when said at least one actuating arm is in the second position, the second end of finger is limited from pivoting and is moved into the throat of the envelope; and when said at least one actuating arm is in the third position, the second end of the finger is free to pivot so as to allow enclosure material to be moved into the envelope through the throat of the envelope; and an actuating device, operatively connected to said at least one actuating arm for moving said at least one actuating arm between the first position, the second position, and the third position.

2. The envelope insertion station of claim 1, wherein the finger has an upper surface such that when said at least one actuating arm is in the second position, the upper surface is in the proximity of a restricting surface so as to limit the pivoting motion of the finger.

3. The envelope insertion station of claim 2, wherein the upper surface is a cam surface.

4. The envelope insertion station of claim 3, wherein the insertion area comprises a support surface for supporting the envelope when the envelope is driven into and placed at the insertion area, and the driving mechanism comprises at least one roller for driving the envelope and placing the envelope on the support surface.

5. The envelope insertion station of claim 4, further comprising a shaft for rotatably mounting said at least one roller, wherein said restricting surface is part of the circumference of the shaft.

6. The envelope insertion station of claim 4, further comprising a shaft for rotatably mounting said a least one roller, and at least one collar mounted on the shaft in relationship to the finger, wherein the restricting surface is part of the collar.

7. The envelope insertion station of claim 4, wherein the finger has an upper surface and a lower surface, the lower surface and the support surface forming a gap therebetween, such that when said at least one actuating arm is in the second position, the upper surface is restricted from moving upward by the restricting surface, thereby limiting the gap to accommodate substantially the thickness of a portion of the envelope.

8. The envelope insertion station of claim 4, wherein the envelope has an upper ply and a lower ply, and wherein the finger has an upper surface and a lower surface, the lower surface and the support surface forming a gap therebetween, such that when said at least one actuating arm is in the second position, the upper surface is restricted from moving upward by the restricting surface, thereby limiting the gap to accommodate substantially the thickness of the lower ply of the envelope.

9. A mailing system comprising:

an enclosure supply station; and an envelope insertion station, disposed in relationship to the enclosure supply station for receiving enclosure material from the enclosure supply station, wherein the envelope insertion station comprises:

an insertion area;

a driving mechanism for driving an envelope into the insertion area, the envelope having a throat; and an envelope opening device, the envelope opening device comprising:

at least one actuating arm movably disposed in relationship to the insertion area between a first position, a second position, and a third position;

at least one finger having a first end and a second end, the first end of said at least one finger pivotably mounted on said at least one actuating arm for pivoting motion such that when said at least one actuating arm is in the first position, the second end of the finger is free to pivot so as to allow movement of the envelope into the insertion area and to be spaced from the throat of the envelope, and when said at least one actuating arm is in the second position, the second end of the finger is limited from pivoting and is moved into the throat of the envelope; and when said at least one actuating arm is in the third position, the second end of the finger is free to pivot so as to minimize friction between the enclosure material and the finger when the enclosure material is moved into the envelope through the throat and;

an actuating device, operatively connected to said at least one actuating an, for moving said at least one actuating arm between the first position, the second, and the third position.

10. An envelope insertion station comprising:

an insertion area;

a driving mechanism for driving an envelope into the insertion area, the envelope having a throat; and an envelope opening device, the envelope opening device comprising:

at least one actuating arm movably disposed in relationship to the insertion area between a first position and a second position;

at least one finger having a first end and a second end, the first end of said at least one finger pivotably mounted on said at least one actuating arm for pivoting motion, such that when said at least one actuating arm is in the first position, the second end of the finger is spaced from the throat of the envelope, and when said at least one actuating ann is in the second position, the second end of the finger is moved into the throat of the envelope; and an actuating device, operatively connected to said at least one actuating arm, for moving said at least one actuating arm between the first position and the second position, and wherein said at least one actuating arm is also movably disposed in a third position after the second end of the finger is caused to move into the throat of the envelope, the third position adjacent to the second position further from the first position, such that when said at least one actuating arm is in the third position, the second end of the finger is free to pivot so as to allow enclosure material to be moved into the envelope through the throat, and wherein the finger has an upper surface such that when said at least one actuating arm is in the second position, the upper surface is in the proximity of the a restricting surface so as to limit the pivoting motion of the finger.

11. The envelope insertion station of claim 10, wherein the upper surface is a cam surface.

12. The envelope insertion station of claim 11, wherein the insertion area comprises a support surface for supporting the envelope when the envelope is driven into and placed at the insertion area, and the driving mechanism comprises at least one roller for driving the envelope and placing the envelope on the support surface.

13. The envelope insertion station of claim 12, further comprising a shaft for rotatably mounting said at least one roller, wherein said restricting surface is part of the circumference of the shaft.

14. The envelope insertion station of claim 12, further comprising a shaft for rotatably mounting said a least one roller, and at least a collar mounted on the shaft in relationship to the finger, wherein the restricting surface is part of the collar.

15. The envelope insertion station of claim 12, wherein the finger has an upper surface and a lower surface, the lower surface and the support surface forming a gap therebetween, such that when said at least one actuating arm is in the second position, the upper surface is restricted from moving upward by the restricting surface, thereby limiting the gap to accommodate substantially the thickness of a portion of the envelope.

16. The envelope insertion station of claim 12, wherein the envelope has an upper ply and a lower ply, and wherein the finger has an upper surface and a lower surface, the lower surface and the support surface forming a gap therebetween, such that when said at least one actuating arm is in the second position, the upper surface is restricted from moving upward by the restricting surface, thereby limiting the gap to accommodate substantially the thickness of the lower ply of the envelope.

* * * * *